US006362742B1

(12) United States Patent
Serenil, Jr.

(10) Patent No.: US 6,362,742 B1
(45) Date of Patent: Mar. 26, 2002

(54) SAFETY FLOAT DEVICE FOR AIR CONDITIONING UNITS

(76) Inventor: Raoul Serenil, Jr., 11809 Nandina Cir., Houston, TX (US) 77065

( * ) Notice: Subject to any disclaimer, the term of this patent is extended or adjusted under 35 U.S.C. 154(b) by 0 days.

(21) Appl. No.: 09/714,924

(22) Filed: Nov. 17, 2000

(51) Int. Cl.[7] ..... G08B 21/00

(52) U.S. Cl. ..... 340/625; 340/604; 340/605; 340/623; 73/305; 73/308; 200/84 A; 200/61.2; 200/DIG. 41

(58) Field of Search ..... 340/604, 605, 340/618, 625, 623; 73/305, 308; 200/84 A, 61.2, DIG. 41

(56) References Cited

U.S. PATENT DOCUMENTS 4,017,842 A * 4/1977 Vineyard
4,284,129 A 8/1981 Rogalski
D261,114 S 10/1981 Kask
4,805,662 A * 2/1989 Moody ..... 340/625
4,814,752 A * 3/1989 Lehman ..... 340/616
4,937,559 A 6/1990 Meacham et al.
5,028,910 A 7/1991 Meacham et al.
5,151,685 A * 9/1992 Spicer et al. ..... 340/605
5,345,224 A 9/1994 Brown
5,609,296 A 3/1997 Imamura et al.
6,035,699 A * 3/2000 Parlante ..... 340/623
6,160,482 A * 12/2000 Hill ..... 340/625

* cited by examiner

*Primary Examiner*—Daniel J. Wu

(57) ABSTRACT

A safety float device for air conditioning units for providing easy and convenient installation of a switch to air conditioning systems. The safety float device for air conditioning units includes a switch assembly having a housing, a switch disposed in the housing, and wires extending from the switch; and also includes a float assembly having an arm member movably connected to the switch, and further having a float support member securely attached to an end of the arm member, and also having a float member securely and removably attached to the float support member; and further includes a fastening assembly being securely attached to the housing of the switch assembly for removably fastening to an air conditioning unit.

15 Claims, 1 Drawing Sheet

SAFETY FLOAT DEVICE FOR AIR CONDITIONING UNITS

BACKGROUND OF THE INVENTION

1. Field of the Invention

The present invention relates to a safety float switch and more particularly pertains to a new safety float device for air conditioning units for providing easy and convenient installation of a switch to air conditioning systems.

2. Description of the Prior Art

The use of a safety float switch is known in the prior art. More specifically, a safety float switch heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,284,129; 5,345,224; 5,609,296; 4,937,559; 5,028,910; and Des. 261,114.

While these devices fulfill their respective, particular objectives and requirements, the aforementioned patents do not disclose a new safety float device for air conditioning units. The inventive device includes a switch assembly having a housing, a switch disposed in the housing, and wires extending from the switch; and also includes a float assembly having an arm member movably connected to the switch, and further having a float support member securely attached to an end of the arm member, and also having a float member securely and removably attached to the float support member; and further includes a fastening assembly being securely attached to the housing of the switch assembly for removably fastening to an air conditioning unit.

In these respects, the safety float device for air conditioning units according to the present invention substantially departs from the conventional concepts and designs of the prior art, and in so doing provides an apparatus primarily developed for the purpose of providing easy and convenient installation of a switch to air conditioning systems.

SUMMARY OF THE INVENTION

In view of the foregoing disadvantages inherent in the known types of safety float switch now present in the prior art, the present invention provides a new safety float device for air conditioning units construction wherein the same can be utilized for providing easy and convenient installation of a switch to air conditioning systems.

The general purpose of the present invention, which will be described subsequently in greater detail, is to provide a new safety float device for air conditioning units which has many of the advantages of the safety float switch mentioned heretofore and many novel features that result in a new safety float device for air conditioning units which is not anticipated, rendered obvious, suggested, or even implied by any of the prior art safety float switch, either alone or in any combination thereof.

To attain this, the present invention generally comprises a switch assembly having a housing, a switch disposed in the housing, and wires extending from the switch; and also includes a float assembly having an arm member movably connected to the switch, and further having a float support member securely attached to an end of the arm member, and also having a float member securely and removably attached to the float support member; and further includes a fastening assembly being securely attached to the housing of the switch assembly for removably fastening to an air conditioning unit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new safety float device for air conditioning units which has many of the advantages of the safety float switch mentioned heretofore and many novel features that result in a new safety float device for air conditioning units which is not anticipated, rendered obvious, suggested, or even implied by any of the prior art safety float switch, either alone or in any combination thereof.

It is another object of the present invention to provide a new safety float device for air conditioning units which may be easily and efficiently manufactured and marketed.

It is a further object of the present invention to provide a new safety float device for air conditioning units which is of a durable and reliable construction.

An even further object of the present invention is to provide a new safety float device for air conditioning units which is susceptible of a low cost of manufacture with regard to both materials and labor, and which accordingly is then susceptible of low prices of sale to the consuming public, thereby making such safety float device for air conditioning units economically available to the buying public.

Still yet another object of the present invention is to provide a new safety float device for air conditioning units which provides in the apparatuses and methods of the prior art some of the advantages thereof, while simultaneously overcoming some of the disadvantages normally associated therewith.

Still another object of the present invention is to provide a new safety float device for air conditioning units for providing easy and convenient installation of a switch to air conditioning systems.

Yet another object of the present invention is to provide a new safety float device for air conditioning units which includes a switch assembly having a housing, a switch disposed in the housing, and wires extending from the switch; and also includes a float assembly having an arm member movably connected to the switch, and further having a float support member securely attached to an end of the arm member, and also having a float member securely and removably attached to the float support member; and further includes a fastening assembly being securely attached to the housing of the switch assembly for removably fastening to an air conditioning unit.

Still yet another object of the present invention is to provide a new safety float device for air conditioning units that allows the user to easily and quickly adjust the height at which the float member should be disposed in the tank.

Even still another object of the present invention is to provide a new safety float device for air conditioning units that doesn't twist and turn during the use thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
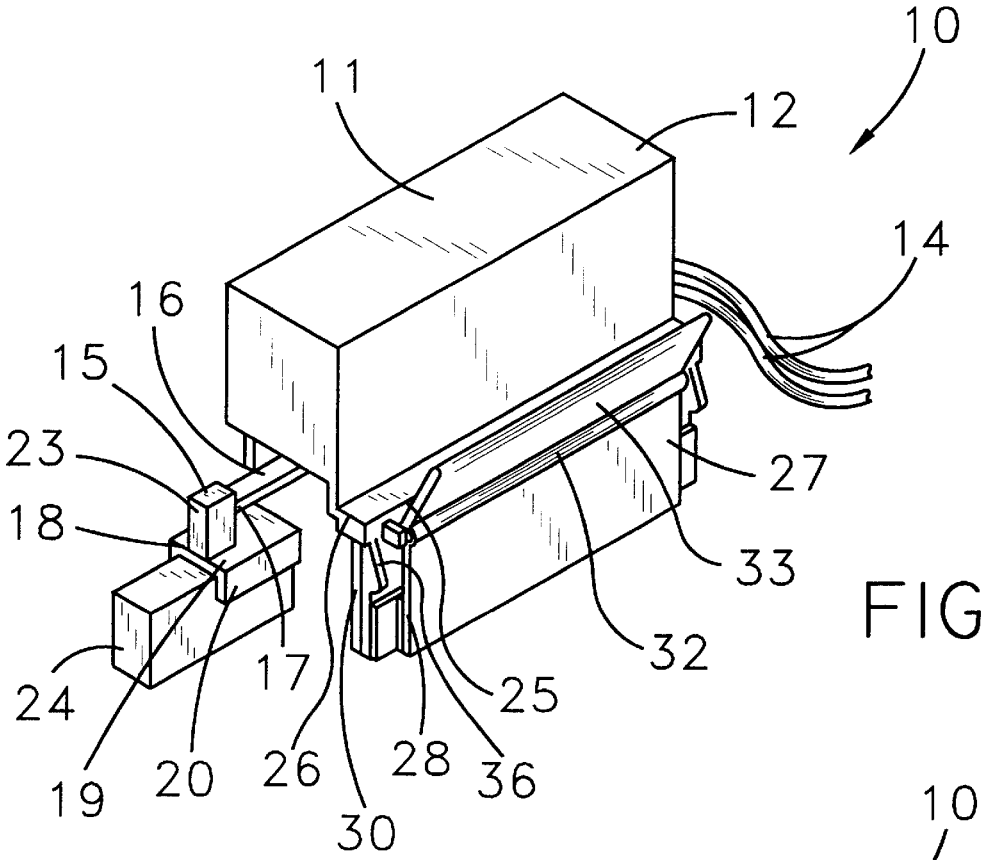
FIG. 1 is a perspective view of a new safety float device for air conditioning units according to the present invention.
Figure 2:
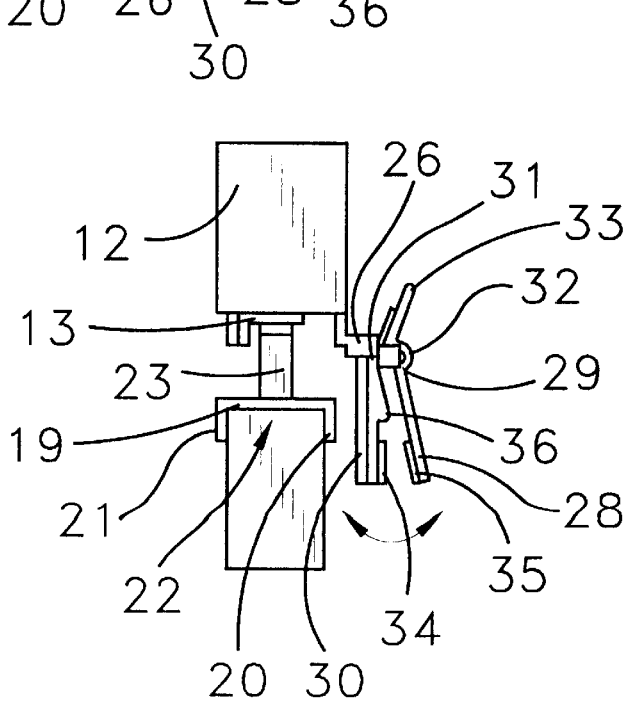
FIG. 2 is an end elevational view of the present invention.

With reference now to the drawings, and in particular to FIGS. 1 through 2 thereof, a new safety float device for air conditioning units embodying the principles and concepts of the present invention and generally designated by the reference numeral 10 will be described.

As best illustrated in FIGS. 1 through 2, the safety float device for air conditioning units 10 generally comprises a switch assembly 11 having a housing 12, a switch 13 securely and conventionally disposed in the housing 12, and wires 14 extending from the switch.

The safety float device 10 also includes a float assembly 15 having an arm member 16 movably and conventionally connected to the switch 13, and further has a float support member 18 securely and conventionally attached to an end 17 of the arm member 16, and also has a float member 24 securely and removably attached to the float support member 18. The float support member 18 includes a main wall 19, a pair of side walls 20,21 integrally extending from longitudinal sides of the main wall 19 and being spaced apart thus forming a slot 22 therebetween, and also includes an arm attachment member 23 being securely and conventionally disposed upon the main wall 19 and being securely and conventionally attached to the end 17 of the arm member 16. The float member 24 is removably engaged in the slot 22 defined by the side walls 20,21 of the float support member 23 with the float member 24 being essentially made of a foam material.

A fastening assembly 25 is securely and conventionally attached to the housing 12 of the switch assembly 11 for removably fastening to an air conditioning unit. The fastening assembly 25 includes a fastening support member 26 which is integrally attached to the housing 12, and also includes a fastening member 27 being securely and conventionally attached to the fastening support member 26. The fastening member 27 includes opposed first and second jaw members 28,30 having first ends 29,31 which are conventionally attached to said fastening support member 26 with the first jaw member 28 being pivotally attached to the fastening support member 26, and also includes a spring 32 being mounted at the first ends 29,31 of the first and second jaw members 28,30 for movably biasing the jaw members 28,30 together to clamp about a portion of the air conditioning unit, and further includes a lever 33 being securely and conventionally attached to the first end 29 of the first jaw member 28 for pivotally moving the first jaw member 28 relative to and away from the second jaw member 30, and also includes a stopper 36 being conventionally disposed upon the second jaw member 30 and extending between the jaw members 28,30 for setting the fastening member 27 at a selected height upon the air conditioning unit. The fastening member 27 also includes pad members 34,35 being securely and conventionally attached to the jaw members 28,30 near second ends thereof and being disposed between the jaw members 28,30. The fastening member 27 extends essentially along a length of the housing 12 of the switch assembly 11 with each of the jaw members 28,30 being essentially plate-like members having a wall. The stopper 36 is disposed upon and protruding from the wall of the second jaw member 30 and is essentially a rib-like member extending along a length of the fastening member 27.

In use, the user clips the fastening member 27 to a tank with the float member 24 being disposed in the tank such that as the level of water rises in the tank, the float member 24 will rise and activate the switch 13 which sends a signal to the shut off valve to essentially any more water from entering the tank.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A safety float device for air conditioning units comprising:

a switch assembly having a housing, a switch disposed in said housing;

a float assembly having an arm member movably connected to said switch, float support member attached to an end of said arm member, and a float member removably attached to said float support member; and a fastening assembly attached to said housing of said switch assembly;

wherein said fastening assembly includes a fastening support member attached to said housing and a fastening member attached to said fastening support member; and wherein said fastening member includes opposed first and second jaw members having first ends which are attached to said fastening support member, and biasing means for biasing said jaw members together.

2. A safety float device for air conditioning units as described in claim 1, wherein said float support member includes a main wall, a pair of side walls extending from longitudinal sides of said main wall and being spaced apart thus forming a slot therebetween, and also includes an arm attachment member being securely disposed upon said main wall and being securely attached to said end of said arm member.

3. A safety float device for air conditioning units as described in claim 1, wherein said float member is removably engaged in said slot defined by said side walls of said float support member, said float member being essentially made of a foam material.

4. A safety float device for air conditioning units as described in claim 1, additionally comprising a stopper being disposed upon said second jaw member and extending between said jaw members for setting said fastening member at a selected height upon an air conditioning unit.

5. A safety float device for air conditioning units as described in claim 4, wherein said stopper is disposed upon and protruding from said wall of said second jaw member and is essentially a rib-like member extending along a length of said fastening member.

6. A safety float device for air conditioning units as described in claim 1, wherein said fastening member also includes pad members being attached to said jaw members near second ends thereof and being disposed between said jaw members.

7. A safety float device for air conditioning units as described in claim 1, wherein said fastening member extends along a length of said housing of said switch assembly.

8. A safety float device for air conditioning units as described in claim 1, wherein each of said jaw members is essentially a plate-like member having a wall.

9. A safety float device for air conditioning units as described in claim 1, additionally comprising a lever attached to said first end of said first jaw member for moving said first jaw member away from said second jaw member.

10. A safety float device for air conditioning units comprising:

a switch assembly having a housing, a switch disposed in said housing, and wires extending from said switch;

a float assembly having an arm member movably connected to said switch, and further having a float support member securely attached to an end of said arm member, and also having a float member securely and removably attached to said float support member; and a fastening assembly being securely attached to said housing of said switch assembly for removably fastening to an air conditioning unit;

wherein said float support member includes a main wall, a pair of side walls extending from longitudinal sides of said main wall and being spaced apart thus forming a slot therebetween, and also includes an arm attachment member being securely disposed upon said main wall and being securely attached to said end of said arm member;

wherein said float member is removably engaged in said slot defined by said side walls of said float support member, said float member being essentially made of a foam material;

wherein said fastening assembly includes a fastening support member which is attached to said housing, and also includes a fastening member being securely attached to said fastening support member;

wherein said fastening member includes opposed first and second jaw members having first ends which are attached to said fastening support member, and also includes a spring being mounted at said first ends of said first and second jaw members for biasing said jaw members together, and further includes a lever being attached to said first end of said first jaw member for moving said first jaw member away from said second jaw member, and also includes a stopper being disposed upon said second jaw member and extending between said jaw members for setting said fastening member at a selected height upon the air conditioning unit.

11. A safety float device for air conditioning units as described in claim 10, wherein said fastening member also includes pad members being attached to said jaw members near second ends thereof and being disposed between said jaw members.

12. A safety float device for air conditioning units as described in claim 10, wherein said fastening member extends along a length of said housing of said switch assembly.

13. A safety float device for air conditioning units as described in claim 10, wherein each of said jaw members is essentially plate-like members having a wall.

14. A safety float device for air conditioning units as described in claim 10, wherein said stopper is disposed upon and protruding from said wall of said second jaw member and is essentially a rib-like member extending along a length of said fastening member.

15. A safety float device for air conditioning units comprising:

a switch assembly having a housing, a switch disposed in said housing, and wires extending from said switch;

a float assembly having an arm member movably connected to said switch, and further having a float support member securely attached to an end of said arm member, and also having a float member securely and removably attached to said float support member, said float support member including a main wall, a pair of side walls extending from longitudinal sides of said main wall and being spaced apart thus forming a slot therebetween, and also including an arm attachment member being securely disposed upon said main wall and being securely attached to said end of said arm member, said float member being removably engaged in said slot defined by said side walls of said float support member, said float member being essentially made of a foam material; and a fastening assembly being securely attached to said housing of said switch assembly for removably fastening to an air conditioning unit, said fastening assembly including a fastening support member which is attached to said housing, and also including a fastening member being securely attached to said fastening support member, said fastening member including opposed first and second jaw members having first ends which are attached to said fastening support member, and also including a spring being mounted at said first ends of said first and second jaw members for biasing said jaw members together, and further including a lever being attached to said first end of said first jaw member for moving said first jaw member away from said second jaw member, and also including a stopper being disposed upon said second jaw member and extending between said jaw members for setting said fastening member at a selected height upon the air conditioning unit, said fastening member also including pad members being securely attached to said jaw members near second ends thereof and being disposed between said jaw members, said fastening member extending essentially along a length of said housing of said switch assembly, each of said jaw members being essentially plate-like members having a wall, said stopper being disposed upon and protruding from said wall of said second jaw member and being essentially a rib-like member extending along a length of said fastening member.

* * * * *